US005826638A

United States Patent [19]

Jelic

[11] Patent Number: 5,826,638

[45] Date of Patent: Oct. 27, 1998

[54] BETWEEN THE GLASS VENETIAN BLINDS

[75] Inventor: Ralph Jelic, Valencia, Pa.

[73] Assignee: International Window Fashions, L.L.C., Pittsburgh, Pa.

[21] Appl. No.: 934,795

[22] Filed: Sep. 22, 1997

Related U.S. Application Data

[63] Continuation-in-part of Ser. No. 720,184, Sep. 25, 1996, Pat. No. 5,699,845.

[51] Int. Cl.[6] ..... A47H 1/00

[52] U.S. Cl. ..... 160/107; 160/173 R

[58] Field of Search ..... 160/107, 173 R, 160/176.1 R, 177 R, 168.1 R, 172 R, 178.1 R; 49/64, 82.1, 87.1, 74.1

[56] References Cited

U.S. PATENT DOCUMENTS

| | | | |
|---|---|---|---|
| 2,283,640 | 5/1942 | Kwon | 156/17 |
| 2,389,956 | 11/1945 | Castilonia | 160/172 R |
| 2,485,217 | 10/1949 | Semilof | 160/178.1 R |
| 2,560,858 | 7/1951 | Grogan | 160/178.1 R |
| 2,639,766 | 5/1953 | Pratt | 160/172 R |
| 2,652,112 | 9/1953 | Walker | 160/173 |
| 2,976,583 | 3/1961 | McCarthy | 20/56.5 |
| 3,201,832 | 8/1965 | Hordis et al. | 49/64 |
| 3,342,243 | 9/1967 | Salter | 160/107 |
| 3,722,572 | 3/1973 | Hall | 49/64 X |
| 4,177,853 | 12/1979 | Anderson et al. | 160/168 R |
| 4,480,674 | 11/1984 | Anderson | 160/107 |
| 4,487,243 | 12/1984 | Debs | 160/178.1 R |
| 4,588,012 | 5/1986 | Anderson | 160/174 |
| 4,643,238 | 2/1987 | Tachikawa et al. | 160/168.1 R |
| 4,664,169 | 5/1987 | Osaka | 160/168 |
| 4,679,610 | 7/1987 | Spraggins | 160/84.02 X |
| 4,685,502 | 8/1987 | Spangenberg | 160/107 |
| 4,687,040 | 8/1987 | Ball | 160/107 |
| 4,817,698 | 4/1989 | Rossini et al. | 160/107 |
| 4,903,213 | 2/1990 | Schnelker | 160/107 |
| 5,000,242 | 3/1991 | Coddens | 160/107 |
| 5,176,192 | 1/1993 | Judkins et al. | 160/84.1 |
| 5,226,466 | 7/1993 | Coddens | 160/107 |
| 5,320,154 | 6/1994 | Colson et al. | 160/121.1 |
| 5,379,825 | 1/1995 | Jelic | 160/107 |
| 5,396,944 | 3/1995 | Rossini | 160/107 |
| 5,573,051 | 11/1996 | Judkins | 160/168.2 |
| 5,655,590 | 8/1997 | Bryant | 160/168.1 R |

FOREIGN PATENT DOCUMENTS

| | | |
|---|---|---|
| 1509182 | 4/1964 | Germany . |
| 2 034 809 | 8/1974 | Germany . |
| 1252878 | 10/1997 | Germany . |
| 706881 | 4/1954 | United Kingdom . |
| 1040757 | 9/1966 | United Kingdom . |

*Primary Examiner*—David M. Purol
*Attorney, Agent, or Firm*—Buchanan Ingersoll, P.C.

[57] ABSTRACT

A window blind for use between double panes of glass has a bottom rail having an outwardly curving top attached along a front edge and along a back edge to an outwardly curving bottom. The top has at least one opening through which the tilt cords pass and the bottom has a hole for each ladder. The rails of a ladder and all tilt cords coplanar with that ladder pass through the hole for that ladder; and are held in place by a rivet passing through the hole in a manner to retain the rails and lift cords passing through that hole. This blind may also have a two piece headrail wherein one piece is plastic and the other pieces is metal to provide a thermal break. A magnetic tilt mechanism is provided in the headrail.

22 Claims, 13 Drawing Sheets

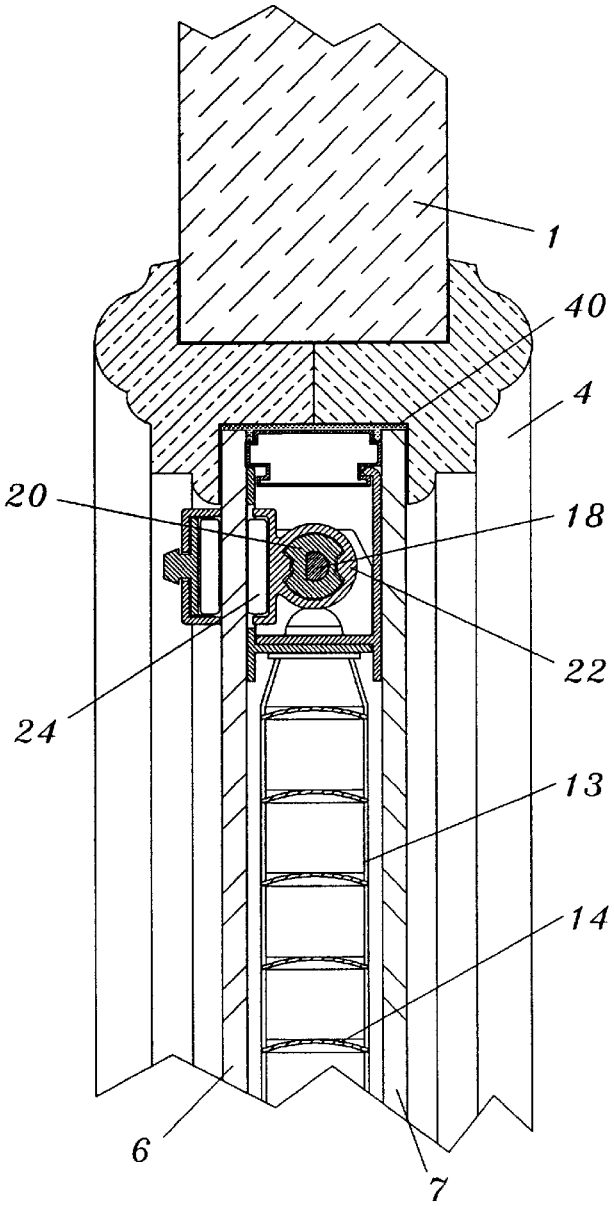
FIG. 9
FIG. 10
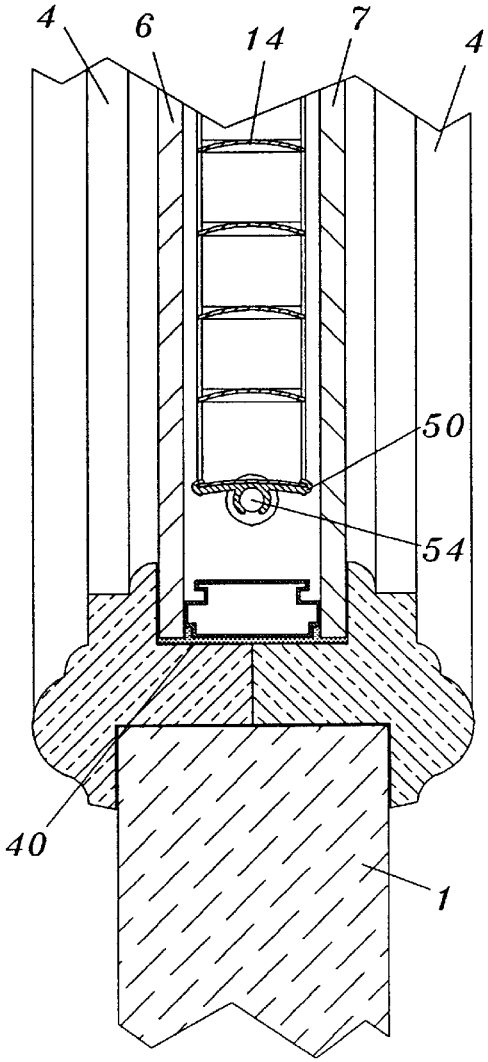

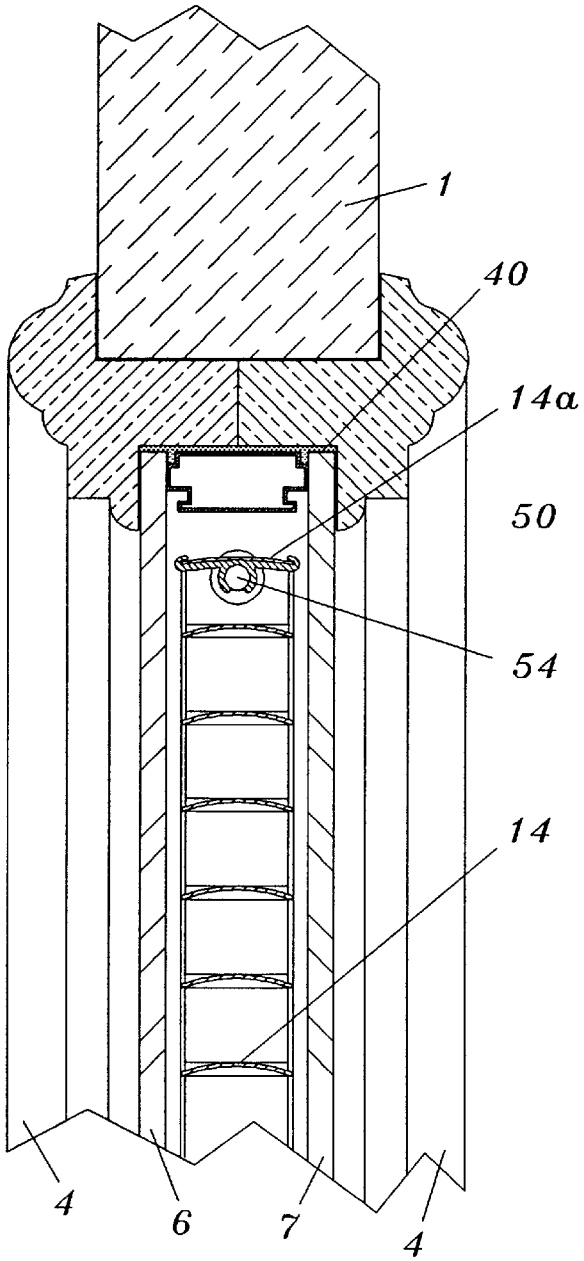
FIG. 11
FIG. 12
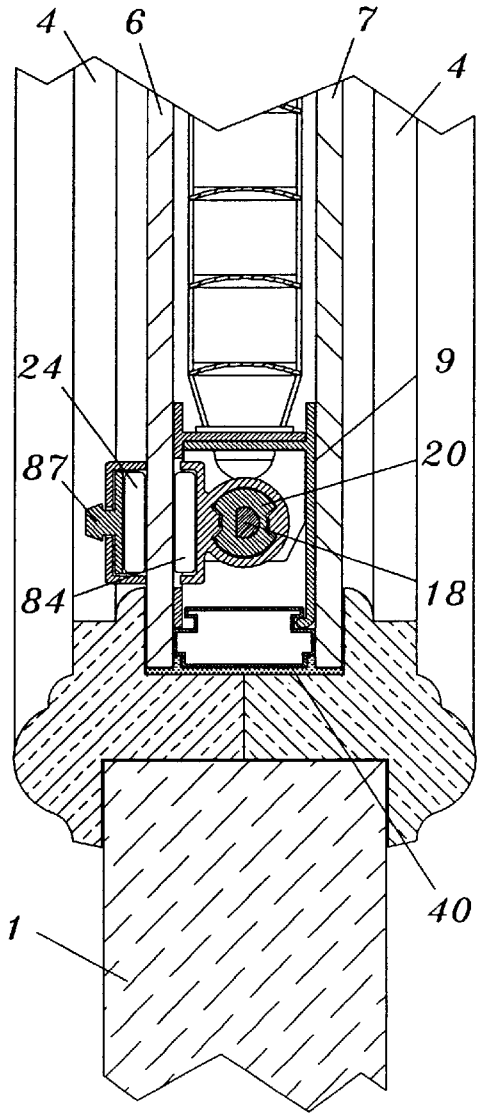

BETWEEN THE GLASS VENETIAN BLINDS

CROSS REFERENCE TO RELATED APPLICATION

This is a continuation-in-part of U.S. patent application Ser. No. 08/720,184, filed Sep. 25, 1996 now U.S. Pat. No. 5,699,845.

BACKGROUND OF THE INVENTION

1. Field of the Invention

The present invention relates to a tilt mechanism for a window blind placed between two panes of glass.

2. Description of the Prior Art

It is well known in the art that double panes of glass in a window provides better insulation than a single pane of glass. It is also known in the art to provide venetian type blinds or pleated shades between two panes of glass. Frequently, these products have the same headrail, bottom rail and window covering material as is used for blinds mounted in front of the window onto the window frame. Other between the glass blinds have a clip in place of the bottom rail which attaches to the window frame. These clips and bottom rails are readily seen by even the casual observer.

A pleated blind between window panes is disclosed in the U.S. Pat. No. 4,913,213 to Schnelker. A venetian or slat blind between panes of glass is disclosed in the U.S. Pat. Nos. 4,687,040 and 4,664,169.

Most venetian blinds can be raised and lowered and their slats can be tilted. When a venetian blind is placed between two panes of glass, the blind often is always kept in a lowered position and only a tilt control is provided. In both types of installations the user must be able to tilt the blind or lift, lower and tilt the blind from one side of the window. Hence, means for controlling tilt, or means for controlling tilt and lift must be provided while maintaining the window seal.

U.S. Pat. No. 4,664,169 to Osaka et al. discloses a device for tilting slats of a venetian blind between double panes of glass. The device uses electrical power driving means to move a piezoelectric bimorph device in a horizontal plane. The piezoelectric bimorph device is mounted to a block having a threaded bore. The block is secured to a screw which is threaded to a nut after passing through one pane of glass. The piezoelectric bimorph device mechanically moves an elongated V-shaped beam under two cross arms which control the rotation of the slats. When the beam is moved, the cross arms are tilted, thereby rotating the slats.

U.S. Pat. No. 4,687,040 to Ball discloses a device for adjusting the tilt angle of slats of a slat blind positioned between the panes of glass. The device includes a hole in one pane of glass and a flexible cable passing through the hole. The cable is connected to a rectangular member which controls the rotation of the slats. When the cable is turned by external torque, the slats are tilted.

U.S. Pat. No. 4,913,213 discloses a pleated blind between double window panes and blind control means for raising and lowering the blind. One embodiment is comprised of an aperture in one pane of glass and a bolt with a center hole mounted in the aperture. An actuator cord passes through the bolt hole and further up and over a screen, if desired, thereby providing an external control mechanism. In another embodiment the actuator cord in routed over the glass housing and any screen housing provided. One of the problems with this blind is that sharp edges of the bolt cut the actuator cord thereby shortening the life of the blind.

Rossini in U.S. Pat. No. 5,396,944 discloses a motorized actuation device for a venetian blind positioned between two panes of glass. The tilt ladders are attached to a tilt shaft which carries a magnet inside the headrail. A second magnet rides on a motor driven worm screw outside the glass. As the motor turns the worm screw, the magnets move turning the tilt shaft. This system requires a housing on the outside of the glass to hold the motor and worm screw. That housing is comparable in size and shape to the headrail.

All of these control systems either have complicated mechanisms or require a headrail which is too wide to fit between the panes of those windows whose panes are not more than ¾ inches apart. Many of them require a hole to be drilled through one pane of glass. This provides an air passage into the space between the panes of glass. That passage reduces the insulation value of the window and allows moisture into the space between the glass panes. During drilling a pane of glass can easily crack or break. Thus, the prior art blinds are either not suitable for currently popular double or triple pane windows, or difficult to make, install and maintain.

Anderson discloses a magnetic actuating mechanism for a venetian blind between two panes of glass in U.S. Pat. Nos. 4,480,674 and 4,588,012. Magnets are attached to one tilt cord on the blind. A second magnet is carried on a housing on the outer surface of the pane of glass and is positioned opposite the tilt cord magnets. In the patent drawings the housing is illustrated as spaced apart from the frame. Because the housing is placed on the surface of the glass several inches from the top, bottom and sides of the frame, it is readily noticeable and some would consider it to be aesthetically objectionable. To avoid this objection, the commercial embodiment of this mechanism has been placed near the window frame but has a cantilever extending from the magnet carrier to the tilt cord. In both embodiments, the edge of the slats adjacent the carrier for the magnets on the tilt cord must be notched to receive the carrier. Anderson also provides a special carrier from which the tilt cords are suspended. As a result a blind having Anderson's tilt mechanism is significantly more expensive to manufacture than other venetian type blinds.

Consequently, there is a need for a tilt mechanism for a venetian type blind placed between the panes of glass that does not require drilling the glass and the window frame. The mechanism should be suitable for use on existing blinds without requiring significant modification. The mechanism must also be easy to use and withstand the temperatures encountered in a double pane window. These temperatures range from below zero to nearly 100° degrees C.

SUMMARY OF THE INVENTION

I provide a tilt mechanism for use on a window blind positioned between double panes of glass on a shaft to which the tilt cords are attached. A nut with attached magnet rides on a double helix threaded portion of the shaft and is adjacent the inside surface of one glass pane. A position slide with attached magnet is placed on the outer surface of the pane of glass opposite the nut. Movement of the position slide and magnet in one direction moves the nut in the same direction causing the shaft to rotate in a clockwise direction. Movement of the position slide and magnet in an opposite direction moves the nut in that opposite direction causing the shaft to rotate in a counterclockwise direction. Rotation of the shaft winds and unwinds the tilt cords to open and close the blind.

I also provide a bottom rail for use on the blind containing the tilt mechanism. A pivot pin extending from each end of the bottom rail fits into a hole or bushing on the frame which separates the glass panes. In one embodiment the tilt cords and ladders are attached to the bottom rail with rivets.

I further prefer to provide a two piece headrail having a light shield. One piece is plastic which provides a thermal break and eliminates fogging of the interior glass pane.

Other details, objects and advantages of the invention will become apparent as the following description of certain present preferred embodiments thereof proceeds. Certain present preferred embodiments of the invention are shown in the accompanying drawings.

BRIEF DESCRIPTION OF THE DRAWINGS

FIG. 9 is a sectional view taken along the line IX—IX in FIG. 1.

FIG. 10 is a sectional view taken along the line X—X in FIG. 1.

FIG. 11 is a sectional view taken along the line XI—XI in FIG. 2.

FIG. 12 is a sectional view taken along the line XII—XII in FIG. 2.

DETAILED DESCRIPTION OF THE INVENTION

Figure 1:
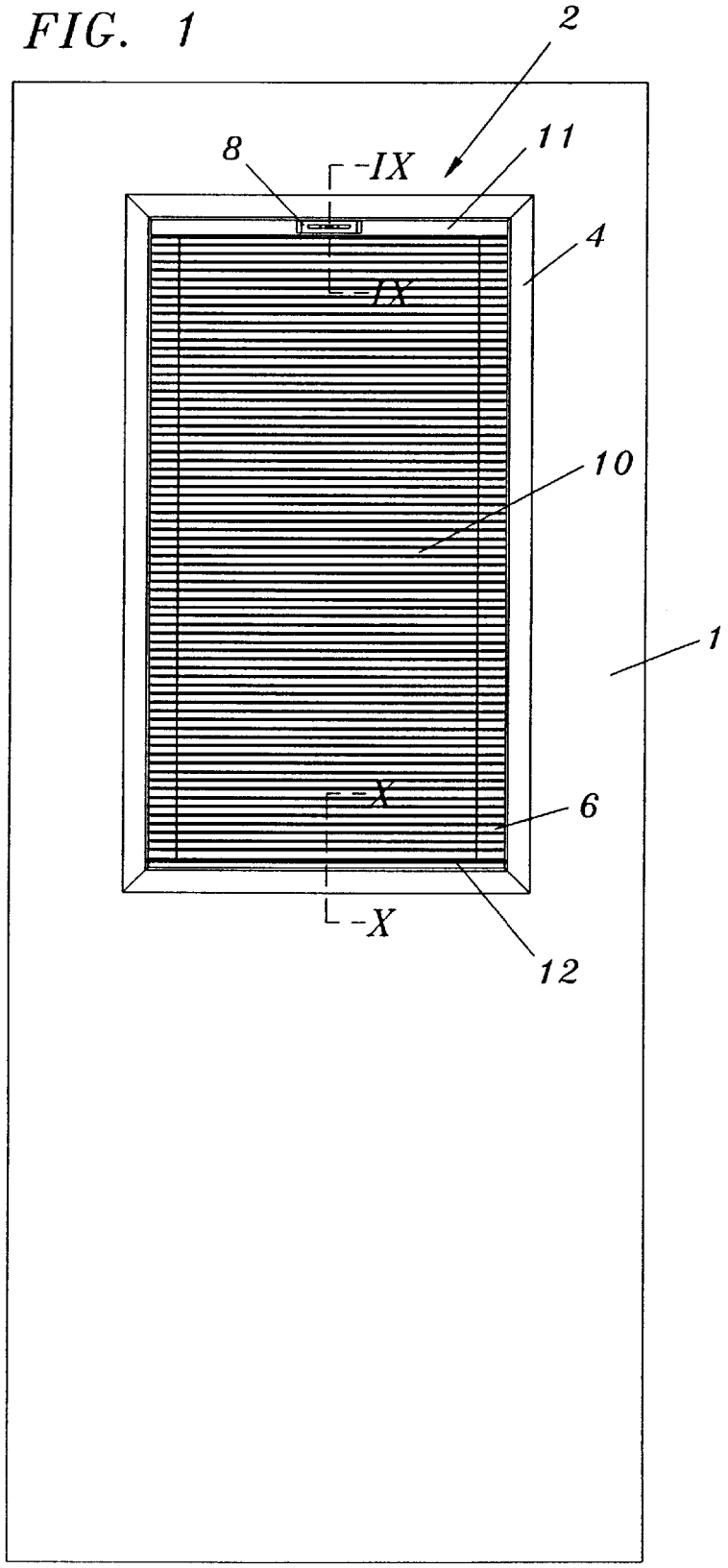
FIG. 1 is a room side view of a venetian blind containing a present preferred tilt mechanism at the top of the blind which is located between two panes of glass mounted in a door.

As shown in FIG. 1 a window blind 10 is positioned between two panes of glass seated in a window frame 4. The blind has a headrail 11, bottom rail 12 and a plurality of spaced parallel slats 14 hung on tilt ladders 13. A slide 8 which operates the tilt mechanism is attached to the outer surface of the room side pane of glass 6.

Figure 2:
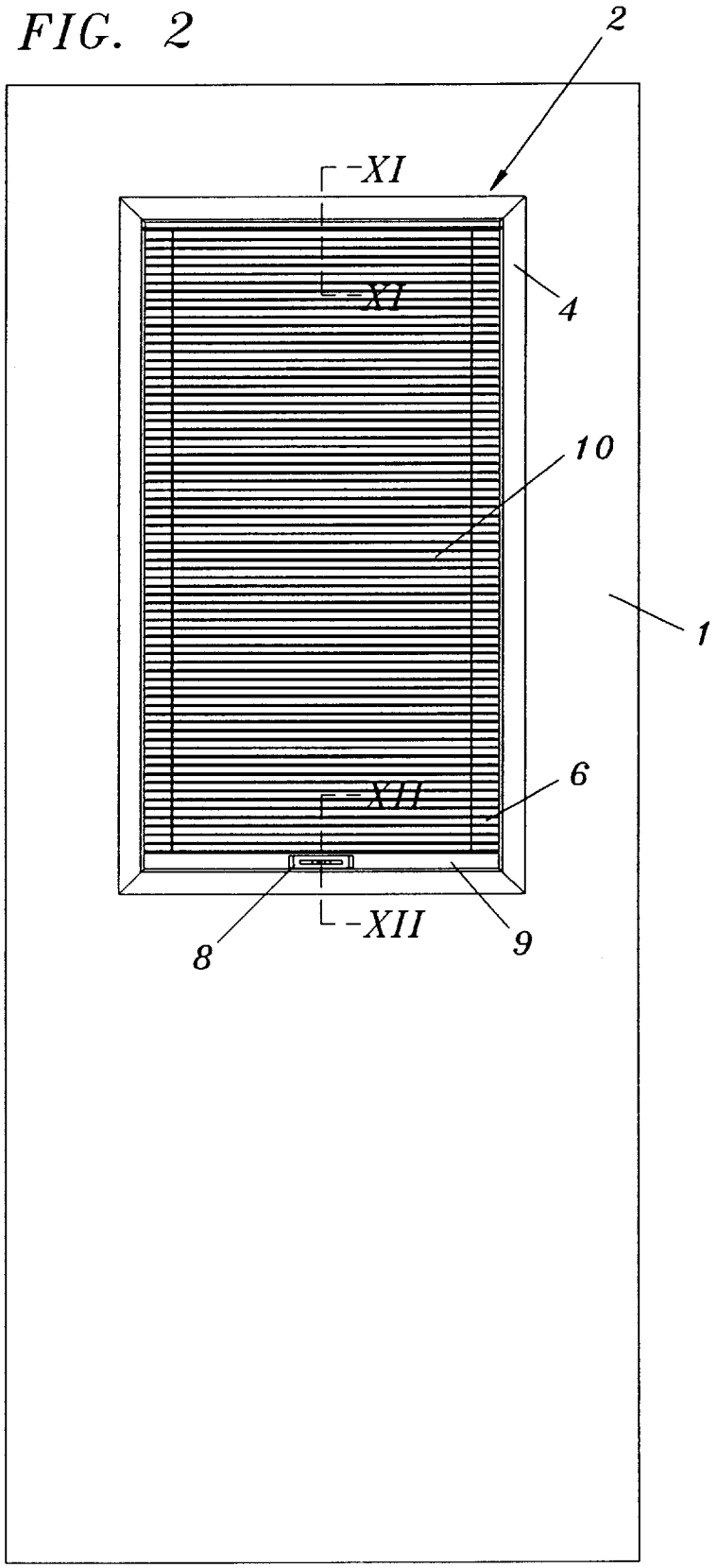
FIG. 2 is a room side view similar to FIG. 1 showing a venetian blind containing a present preferred tilt mechanism at the bottom of a blind which is located between two panes of glass mounted in a door.

FIG. 2 is similar to FIG. 1 except that the tilt mechanism is in a housing 9 at the bottom of the blind. Hence, the slide 8 which operates the tilt mechanism is at the bottom on the window.

Figure 3:
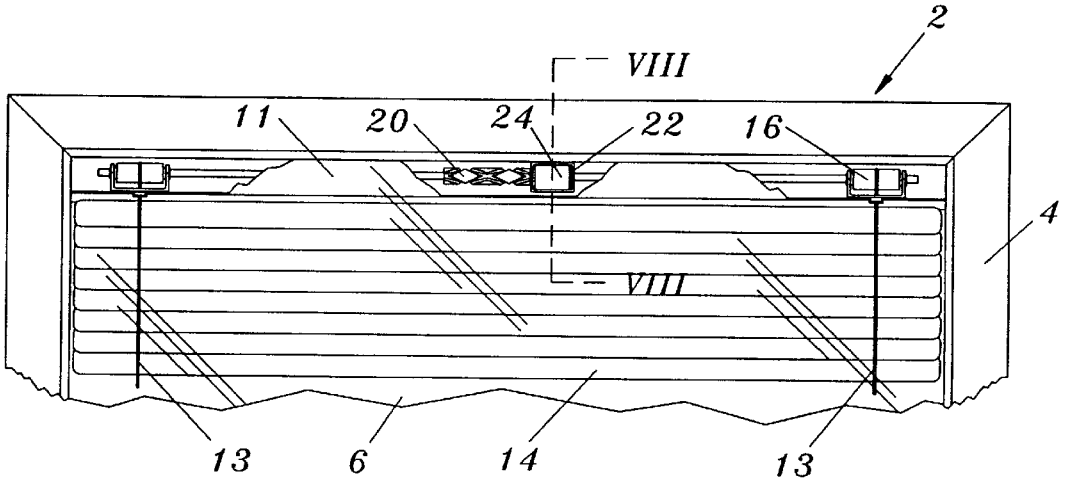
FIG. 3 is room side fragmentary view partially cut away showing a top portion of the glass frame with the blind in closed, tilt in, position.
Figure 4:
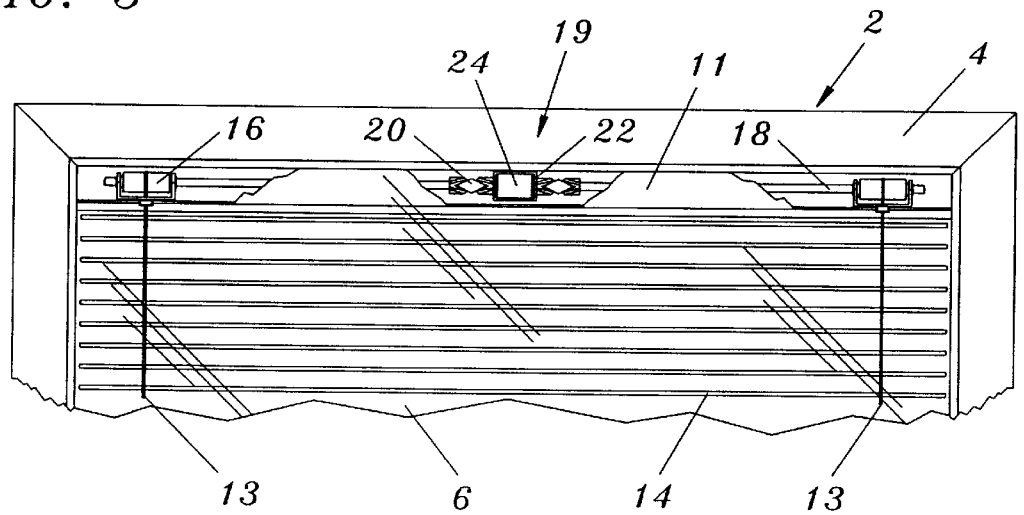
FIG. 4 is room side fragmentary view partially cut away showing a top portion of the glass frame with the blind in an open position.
Figure 5:
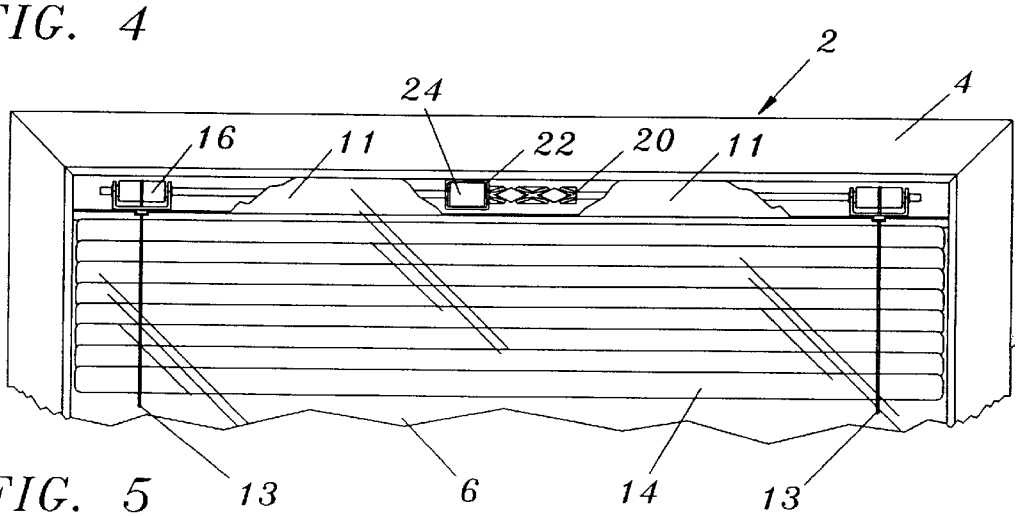
FIG. 5 is room side fragmentary view partially cut away showing a top portion of the glass frame with the blind in a closed, tilt out, position.
Figure 6:
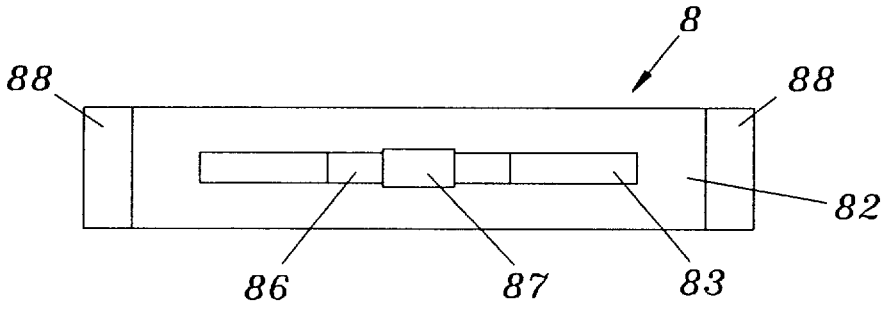
FIG. 6 is a front view of a present preferred tilt slide housing.
Figure 7:
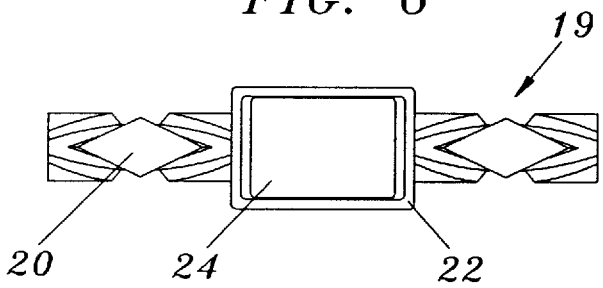
FIG. 7 is a front view of a present preferred double helix threaded tilt assembly.
Figure 8:
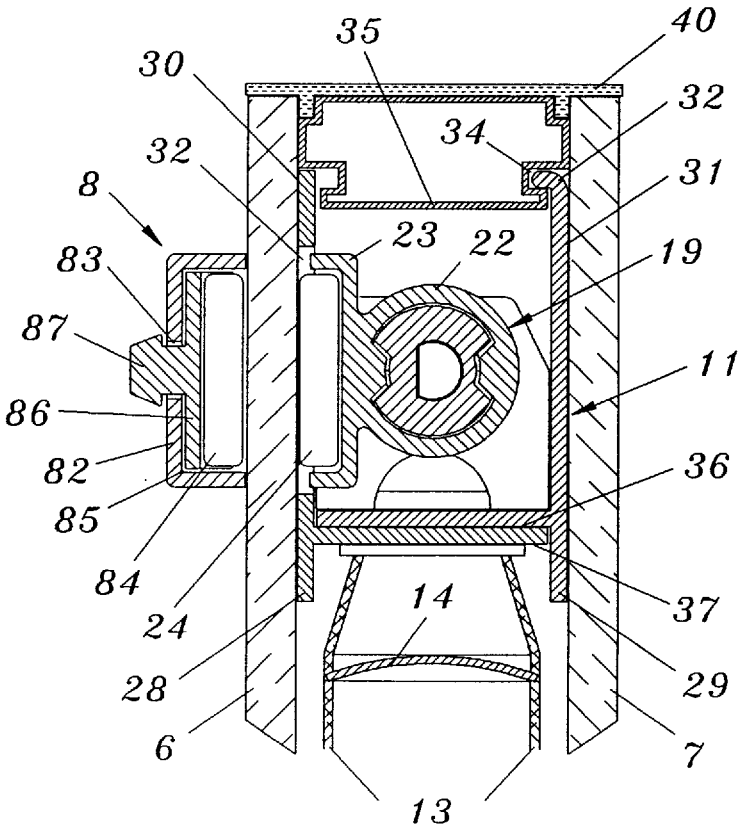
FIG. 8 is a sectional view taken along the line VIII—VIII in FIG. 3.

My tilt mechanism has two basic components, a tilt slide housing 8 which fits on the outside surface of the room side pane of the glass and a threaded tilt assembly 19, shown in FIG. 7, which is in the headrail or in a housing at the bottom of the shade. The operation of my tilt mechanism can be most clearly seen with reference to FIGS. 3 through 8. Venetian blinds can be operated from a closed, tilt in position shown in FIG. 3 through an open position shown in FIG. 4 to a closed, tilt out position shown in FIG. 5. This is accomplished by moving one rung of the tilt ladder 13 relative to the opposite rung of the tilt ladder. One method is to attach the tilt ladder 13 to a drum 16 on a shaft 18 as shown in FIGS. 3, 4 and 5. Rotation of the shaft causes one tilt cord to move up and the opposite tilt cord to move down. If desired, a rocker arm or other connector could be used in place of drum 16.

I provide a threaded portion 20 on shaft 18 and a nut 22 on the threaded portion. As can be seen in FIG. 3, when the nut 22 is at the right end of the threaded shaft the venetian blind will be in a closed, tilt-in position. Movement of the nut 22 to the center of the threaded portion 20 moves the tilt ladder so that the slats are in an open position shown in FIG. 4. Continued movement of the nut 22 to the left end of the threaded portion positions the slats in a tilt out position shown in FIG. 5. I prefer to provide a double helix thread on the threaded portion 20. This type of thread offers less restrictive, equalized turning force for shaft rotation and reduces the necessary travel distance. I have found that a threaded portion 2.85 inches in length having a 1.9 inch lead provides the necessary slide travel for full operation of the blind. A lead of 1.9 inches in combination with the helix angle of 30.76 degrees and a lead angle of 59.24 degrees provides a 1.131 inch circumference which enables a finer tilt control as well as a reduction of the tilting force as compared to smaller leads. One could, however, use a single helix thread or standard screw thread, but a higher force would be required to rotate the shaft. The threaded portion preferably is an injection molded thermoplastic. A double helix threaded nut 22 is carried on the threaded portion 20. The nut has a magnet carrier 23 which holds magnet 24. The nut and magnet carrier preferably are also injection molded from the same material used for the threaded portion 20. I prefer that magnet 24 be a neodymium magnet. This type of magnet contains neodymium rare earth material bonded into an epoxy material that can be easily machined and readily drilled. Neodymium magnets are more resistant to cracking and chipping than are other rare earth magnets and has a very strong magnetic field. One could use cobalt magnets or other types of magnets. However, neodymium may turn less brittle than cobalt and can operate at temperatures up to 100° C. Neodymium magnets are also available at a lower cost than other types of rare earth magnets.

The slide assembly 8 contains a generally rectangular housing 82 with slot 83 therein. A second magnet 84 is contained within cavity 85 in the housing 82. The magnet 84 is attached to a carrier 86 which has a tab 87 extending through slot 83. Shoulders 88 are provided at opposite ends of the housing 82. The slide assembly is attached to the glass by an adhesive applied to the underside of shoulders 88. The slide housing 82 is positioned on the glass so that magnet 84 is opposite magnet 24 as shown most clearly in FIG. 8. Cavity 85 has a length approximately equal to the length of the threaded portion 22. Thus, as tab 87 is used to move the magnet 84 the magnetic attraction between magnets 84 and magnet 24 will cause nut 22 to move in the same direction and the same distance as tab 87 is moved. Since the nut 22 is threaded, movement of the nut will cause the threaded portion 20 and attached shaft 18 to rotate in a clockwise or counter clockwise direction depending upon the direction which tab 87 is moved. Such rotation will cause movement of the tilt cords 13 which are attach to drums 16 on shaft 18 thereby opening or closing the blind.

Figure 20:
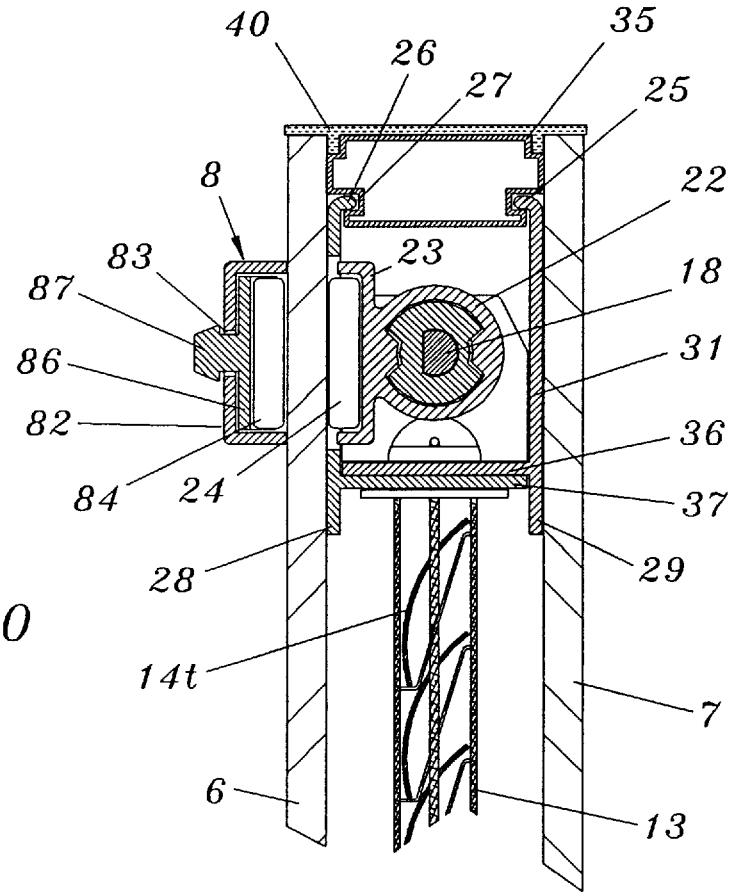
FIG. 20 is a sectional view similar to FIG. 9 showing the top portion of the blind in tilted, closed position with a slightly different headrail configuration.

A very common type of double pane window has two panes of glass separated by a roll formed or extruded tubular structure at the edges of the glass panes. This assembly is then contained within a frame. A gasket or an epoxy material is provided between the edges of the glass and frame to seal the space between the two panes of glass. This type of window has been illustrated in FIGS. 1, 2, 8, 9, 10, 11 and 12. As shown most clearly in FIG. 8 I prefer to provide a two piece headrail 11 having a front portion 30 and a rear portion 31. The front portion abuts the inside surface of the room side pane of glass 6. A notch 32 is cut in the front 30 of the headrail so that magnet 24 can extend through the slot and press against the glass 6. This arrangement increases the magnetic attraction between magnet 24 and magnet 84. The rear portion 31 of the headrail is formed to have a rim 32 which fits within a slot 34 in the channel 35 that separates the front, room side pane of glass 6 from the rear, exterior pane of glass 7. Since the channels 35 which separate the double panes of glass 6 and 7 are conventionally formed to have slot 34, the provision of tab 32 on the back of the headrail 11 allows the blind to be hung from the channel which separates the two panes of glass. This arrangement provides a snap fit of the blind to the channel making installation of the blind very simple. In another embodiment shown in FIG. 20 a tab or ridge 26 is also provided on the front portion 30 of the headrail. A second inwardly extending tab or ridge 25 is provided on the inner surface of the rear portion. Ridges 25 and 26 fit within grooves 27 in channel 35 to provide mounting returns for hanging the blind. The headrail is also held in place by the exterior pane of glass 7 pressing against the back 31 of the headrail. Although not clearly shown in FIGS. 8 and 20 the front portion and rear portion of the headrail have an elongate face which has an outer surface that abuts the glass pane 6 or 7. Mating and interlocking base portions 36 and 37 extend from the inner surfaces of the front face and the rear face. Preferably there is a keeper (not shown) or slot (also not shown) provided in base 36 which receives base 37. This arrangement allows the back of the headrail to be slid into the slot or keeper and on base 36 as well as into the slot 34 in channel 35. Consequently, my tilt mechanism can be mounted between two panes of glass without drilling or cutting either pane of glass. It also does not require that the seal 40 placed between the edges of panes 6 and 7 and the window frame 4 to be broken. Also, a standard double pane window can be used and need not be modified to accommodate the blind and tilt mechanism. I prefer to make the front 30 of the two piece headrail of plastic and the rear portion 31 as a metal extrusion. This provides a thermal break between the inside window pane and the outside window pane. The tilt mechanism can be located at the top or bottom of the window. In the embodiment shown in FIG. 9 the tilt mechanism is mounted in a headrail at the top of the window. In the embodiment shown in FIG. 12, the tilt mechanism is mounted in a housing 9 at the bottom of the window.

The front portion 30 and rear portion 31 of the headrail are configured to have skirts 28 and 29 which extend from the front face and the rear face adjacent base portions 36 and 37. As can be most clearly seen in FIG. 20, the skirts cover the gap between the top slat 14 and the headrail. This light shield enhances privacy as well as blocks light.

Figure 13:
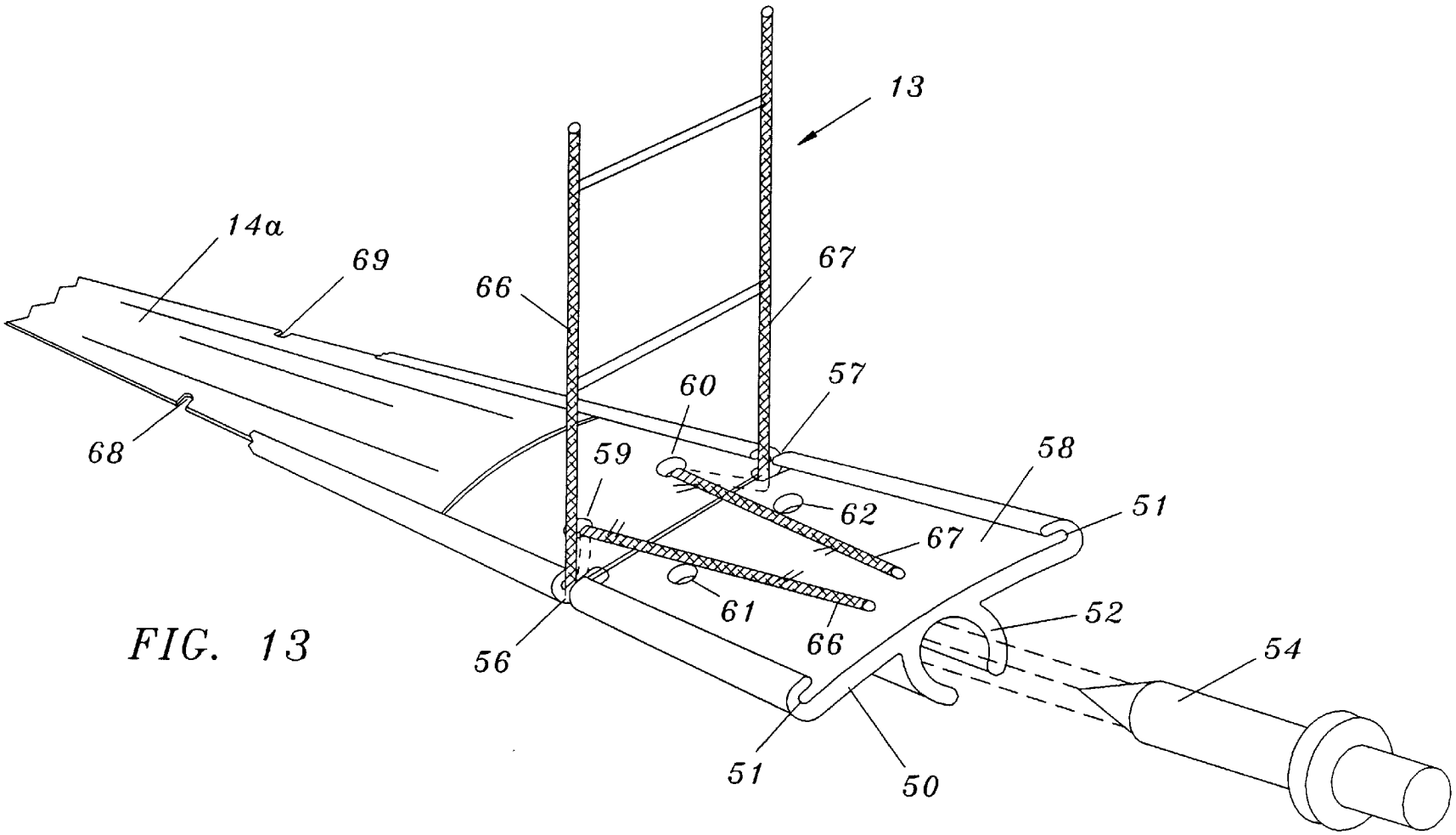
FIG. 13 is a perspective view of a portion of a present preferred, partially assembled bottom rail having a tilt bearing to which the ladder cord is attached and a pivot pin.
Figure 14:
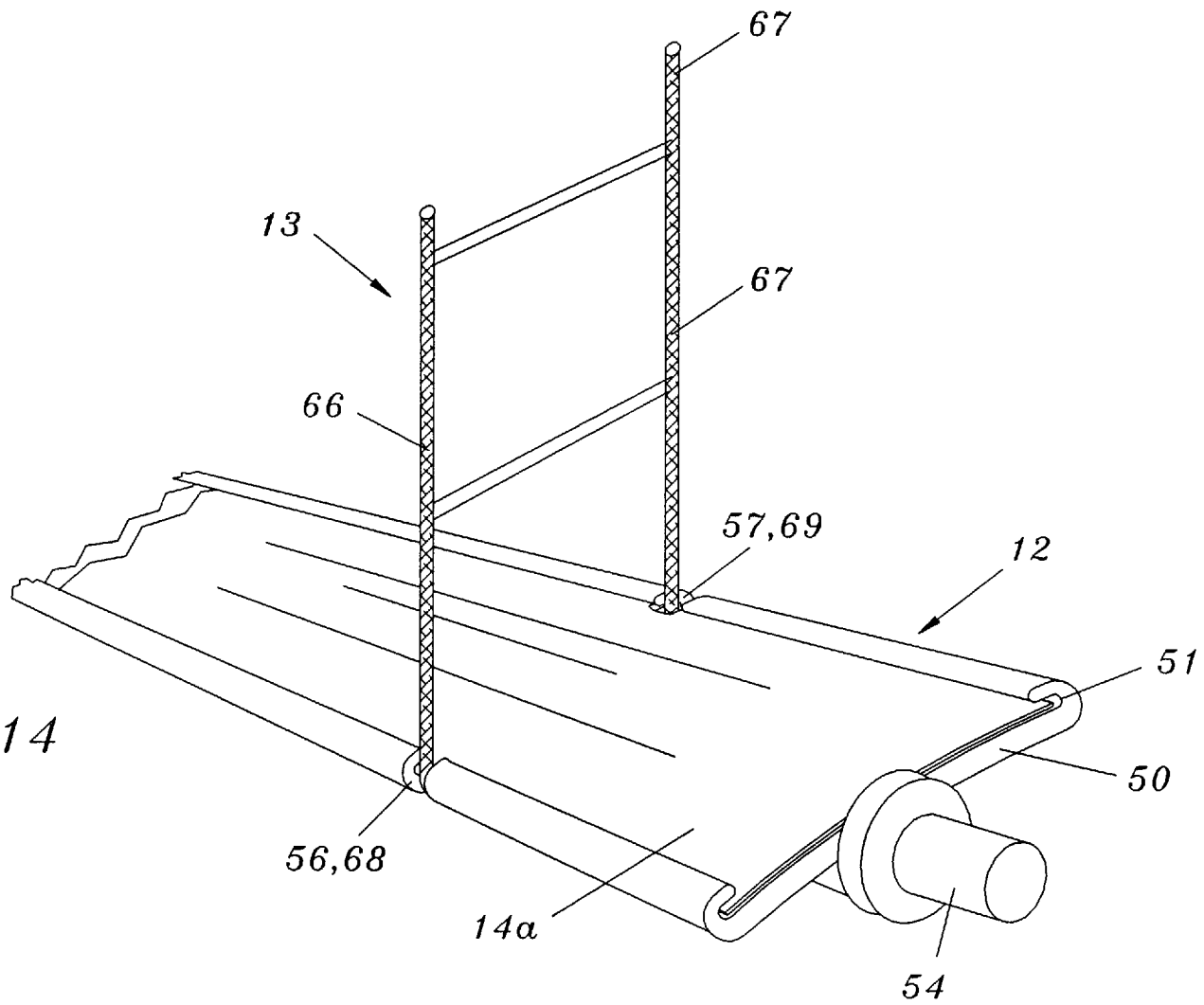
FIG. 14 is a perspective view similar to FIG. 13 of the assembled, present preferred bottom rail.
Figure 15:
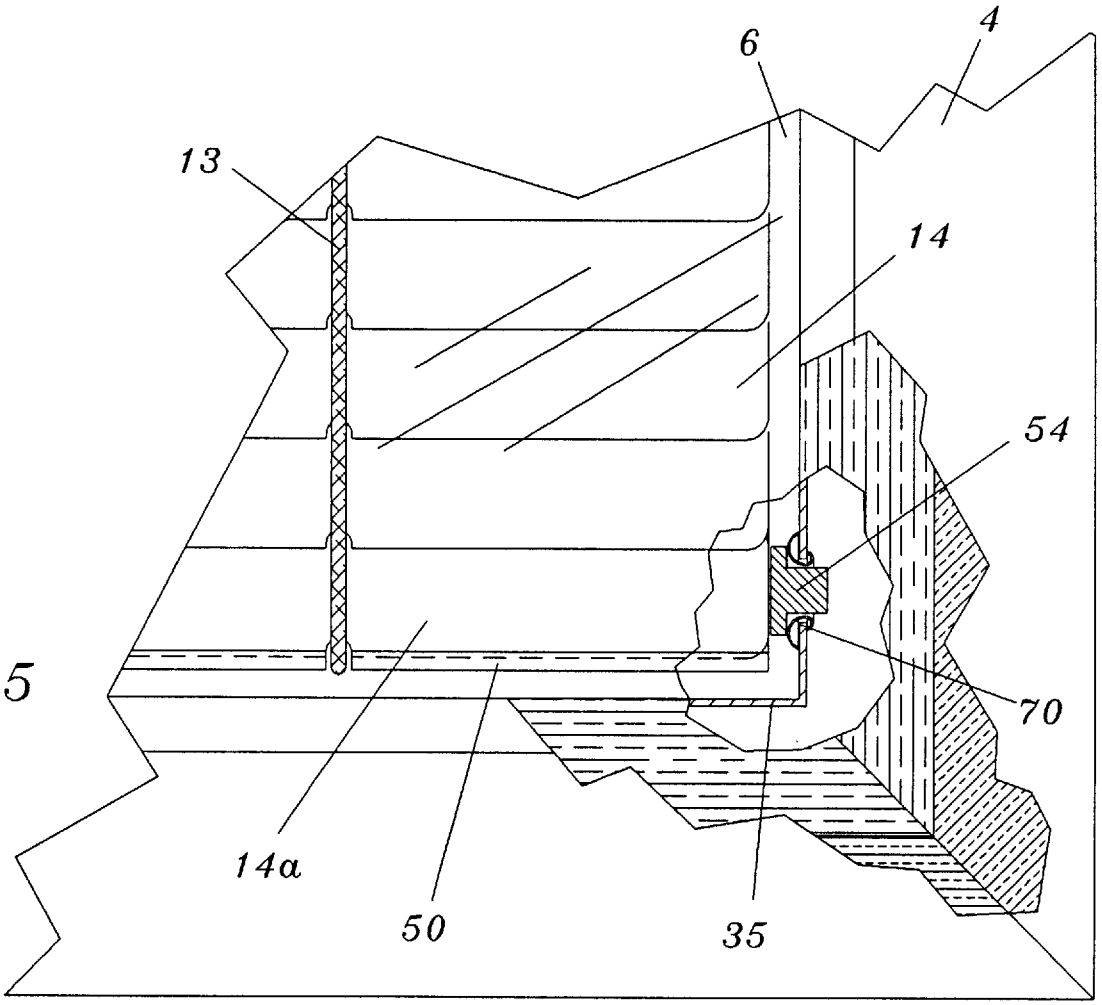
FIG. 15 is a fragmentary view showing a corner of the frame and present preferred bottom rail attached to the frame.
Figure 18:
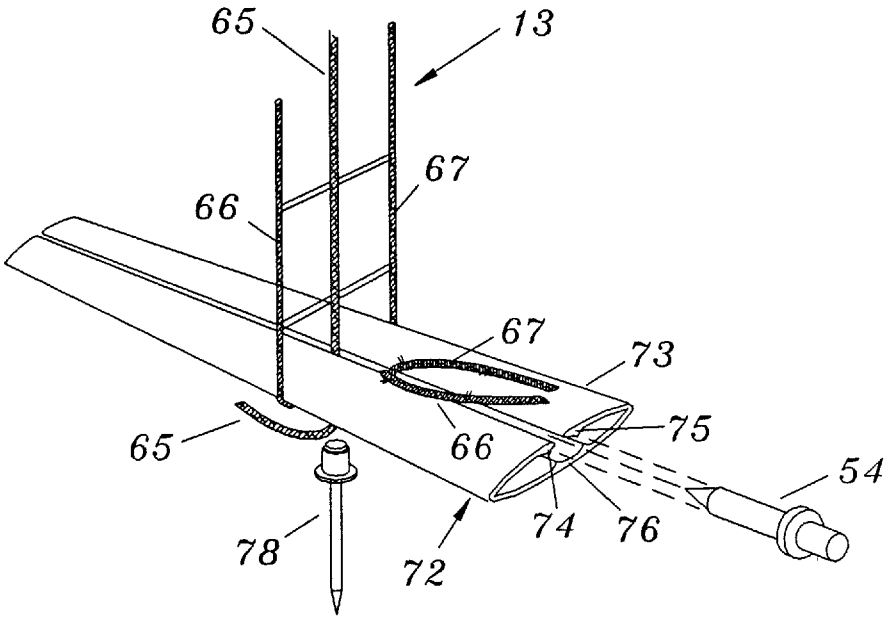
FIG. 18 is perspective view of a bottom rail used in a second preferred embodiment of the blind.
Figure 19:
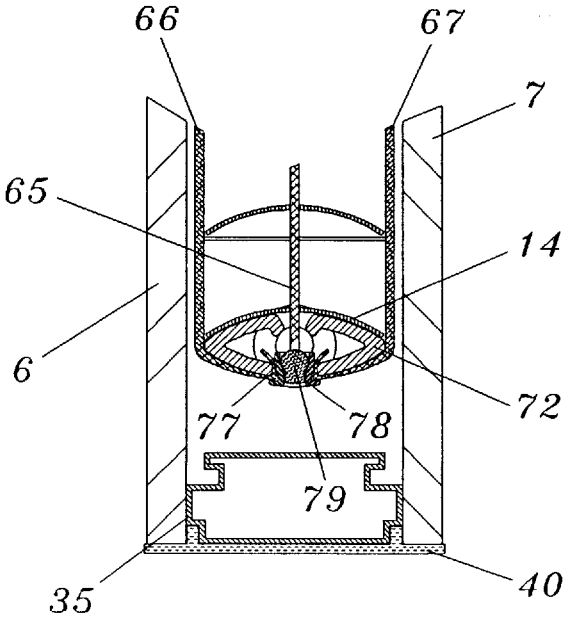
FIG. 19 is a side view of the lower portion of the second preferred blind.

To maintain the blinds in position between the panes of glass I prefer to pivotably attach the bottom rail to the window frame or channel separating the two panes of glass. To achieve that I prefer to provide a bottom rail shown in FIGS. 13 and 14 or the bottom rail shown in FIGS. 18 and 19. The preferred bottom rail shown in FIGS. 13 and 14 has a channel housing 50 having slots 51 along its opposite edges. These slots 51 are spaced apart and sized to receive a slat 14*a*. A boss 52 is provided on the underside of channel housing 50. Boss 52 is sized to receive one end of pivot pin 54. The opposite end of pivot pin 54 fits within a hole or bushing 70 provided in the channel separating the panes of glass or in the window frame as shown in FIG. 15. Slots 56 and 57 are provided on opposite edges of the housing 50 to receive rungs 66 and 67 of the tilt ladder 13. As shown in FIG. 13, rungs 66 and 67 are routed through slots 56 and 57 along the underside of housing 50, though holes 59 and 60 and laid on the top surface 58 of housing 50. Holes 61 and 62 can be used instead of holes 59 and 60 or the ends of rungs 66 and 67 could each be routed through a pair of holes. Slat 14*a* is then slid onto housing 50 so that slots 68 and 69 in slat 14 align with slots 56 and 57 and housing 50. When fully assembled as shown in FIG. 14, the rungs 66 and 67 will fit through the slots 56 and 57 in the housing 50 as well as the slots 68 and 69 in slat 14*a*. Since slat 14*a* is retained within slots 51 on the housing the slat will press the ends of rungs 66 and 67 against the top surface 58 of the housing 50 to retain the tilt ladder 13. Consequently, as the rungs 66 and 67 of tilt ladder 13 are moved relative to one another, the bottom rail housing 50 will pivot around pivot pins 54 provided at each end of the housing. I prefer to manufacture housing 50 as an aluminum extrusion so that top surface 58 has the same curvature as the underside of slat 14*a*. Slat 14*a* which attaches to the housing 50 preferably is of the same width as the other slats 14 used in the blind. The narrow profile of the housing 50 allows the bottom rail to pivot by as much as 150° to almost 180° offering tighter closure than other bottom rails. Tighter closure allows less light passage and provides greater privacy. This bottom rail is inexpensive to manufacture and easily assembled.

Figure 16:
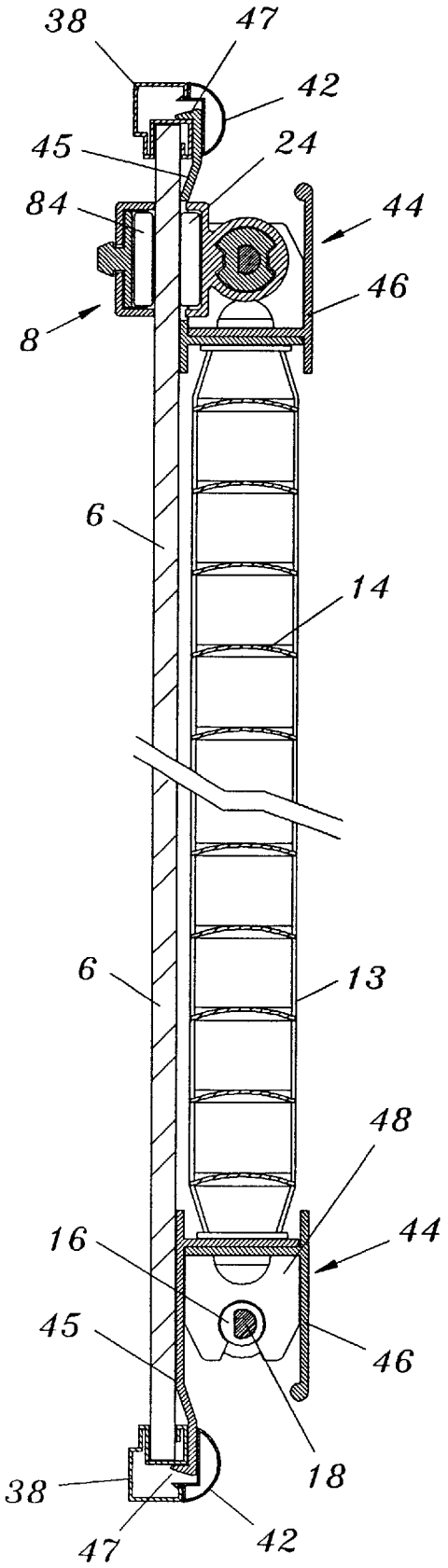
FIG. 16 is a sectional view of a second present preferred blind which contains my tilt mechanism and is hung on a window.
Figure 17:
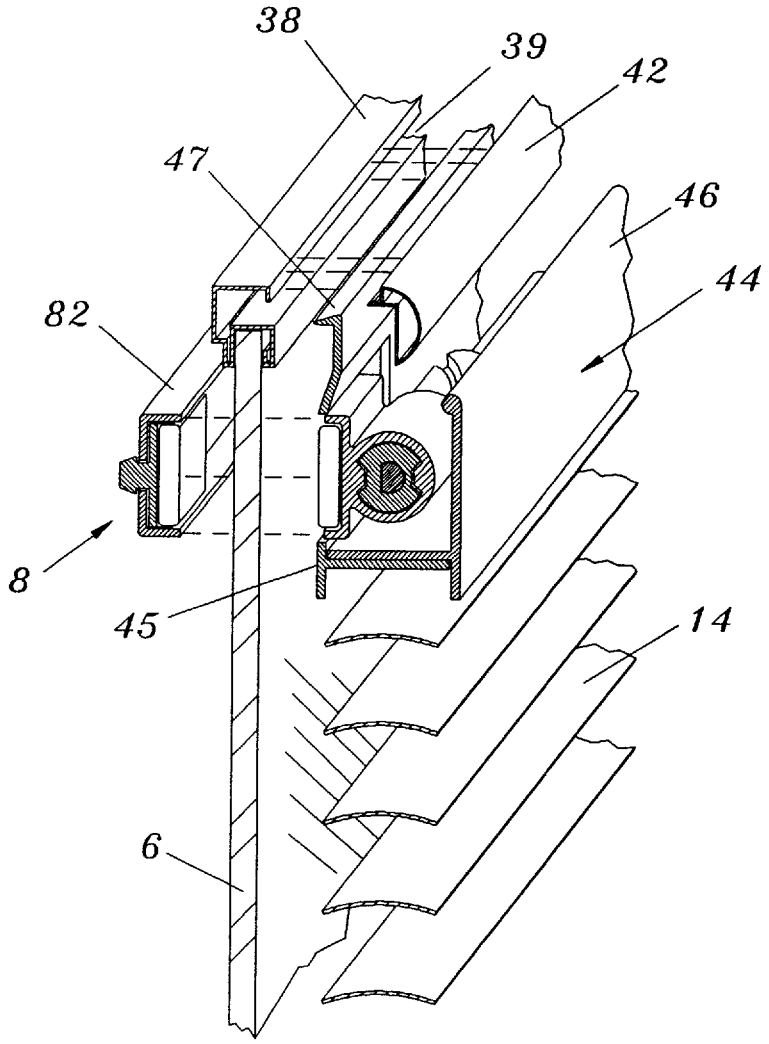
FIG. 17 is an exploded view of the upper left portion of the blind shown in FIG. 16.

A second present preferred blind containing my tilt mechanism is shown in FIG. 16. In this blind the same housing 44 is used at the top and bottom of the blind. Like the headrail in the first embodiment, housing 44 has a front portion 45 which abuts the glass 6 and a rear portion 46. The front portion and rear portion have mating and interlocking base portions. The channels 38 which hold pane of glass 6 are conventionally formed to have slot covered by a seal 42. Tab 47 is provided on the front portion of the housing. The tabs 47 on both the top housing and the bottom housing allow the blind to be hung from the channels at the top and bottom of the pane of glass 6. This arrangement provides a snap fit of the blind to the channel making installation of the blind very simple. In FIG. 16 the tilt mechanism is shown in the top housing, but the tilt mechanism could be in the bottom housing. The tilt mechanism is the same as in the previous embodiment. A slot which receives magnet 24 is cut in the front portion of the top housing which carries the tilt mechanism. The lower ends of the tilt ladders 13 are attached to drums 16 carried on shaft 18 in the bottom housing. That shaft 18 is held by brackets 48.

The second present preferred bottom rail 72 has an extruded flattened oval body 73 having a curved top and a curved bottom that are connected along parallel front and back edges. If desired these edges may have sufficient height as to be considered walls. Yet, I prefer to call this structure an edge. The ends of the housing 74 and 75 along with a portion 76 of the base of the housing are configured to receive and grip one end of pivot pin 54. As in the embodiment shown in FIGS. 13 and 14, the opposite end of the pivot pin 54 fits within a hole or bushing provided in the channel separating the panes of glass or in the window frame as shown in FIG. 15. The blind will have at least two ladders and two lift cords. Each lift cord passes through holes in the blind slats and is positioned between the rails of a ladder. Hence, the lift cord 65 shown in FIG. 15 lies in the same plane as the ladder rails 66 and 67 or is so close to that plane as to be considered to be substantially in that plane. The rails 66 and 67 of the ladder extend around the edges of the bottom rail and into a hole 77. The lift cord 65 extends through the same hole 77. After the lift cord and ladder rails have been placed within the hole a pop rivet 78 is inserted. The ball portion 79 causes the pop rivet 78 to expand outwardly gripping the ladder rails 66 and 67 and the lift cord 65. Then excess length of lift cord and ladder rails is trimmed. If desired the excess length of ladder rails may be stored within the bottom rail. Consequently, it is unnecessary to tie knots in the end of the rails or lift cords as is conventionally done in nearly all bottom rails. Use of the pop rivet greatly simplifies installation. As can be seen most clearly in FIG. 19 the upper surface of the bottom rail is configured to have the same convex shape as the slat 14 which lays upon it. This bottom rail can be made to have a height of from 0.175 to 0.25" (4.45 millimeters to 6.35 millimeters). This profile makes the bottom rail appear to be a slat to the casual observer providing a very pleasing appearance to the blind. The bottom rail shown in FIGS. 18 and 19 can be made to have a width of 0.5 to 0.725" (12.7 millimeters to 18.41 millimeters) and thus will fit between the panes of those windows being currently manufactured which have a blind between the glass.

Although I have described and shown certain present preferred embodiments of my invention, it should be understood that the invention is not limited thereto but may be variously embodied within the scope of the following claims.

I claim:

1. A window blind of the type having a headrail, a bottom rail, a plurality of lift cords extending from the headrail to the bottom rail, a plurality of slats between the bottom rail and the headrail, and a plurality of ladders on which the slats rest, each ladder having a pair of spaced apart rails, each lift cord being substantially coplanar with the rails of a ladder, wherein the bottom rail comprises:

a. an elongated body having a top attached along a front edge and along a back edge to a bottom, the top having at least one opening through which the lift cords pass and the bottom having a hole for each ladder wherein the rails of a ladder and all lift cords coplanar with that ladder pass through the hole for that ladder; and b. a rivet passing through each hole retaining the rails and lift cords passing through that hole by frictionally engaging the rails and lift cords with said hole.

2. The window blind of claim 1 wherein the slats are curved and have a same curvature as the top of the bottom rail.

3. The window blind of claim 1 wherein the elongated body is an extrusion.

4. The window blind of claim 1 wherein the elongated body is a plastic.

5. The window blind of claim 1 also comprising pivot pins attached to opposite ends of the bottom rail.

6. The window blind of claim 5 wherein the bottom rail is sized and configured to permit rotation of the bottom rail about the pivot pins of as much as 150° to 180°.

7. The window blind of claim 1 wherein one rail of each ladder extends over the front edge and one rail of each ladder extends over the back edge.

8. The window blind of claim 1 also comprising a bottom slat attached to the top of the bottom rail.

9. The window blind of claim 1 wherein the headrail is comprised of:

a. a front portion comprised of an elongated front face having an inside surface and an outside surface, and a front portion base extending from the inside surface; and b. a rear portion comprised of an elongated rear face having an inside surface and an outside surface, and a rear portion base extending from the inside surface of the rear face and attached to the front portion base.

10. The window blind of claim 9 wherein one of the front portion and the rear portion is plastic and the other portion is metal.

11. The window blind of claim 9 also comprising a front inwardly extending tab attached to the inner surface of the front portion opposite the front portion base and a rear inwardly extending tab attached to the inner surface of the rear portion opposite the rear portion base and across from the front inwardly extending tab.

12. The window blind of claim 1 wherein a gap exists between a top slat and the headrail when the slats are in a fully tilted position and also comprising at least one skirt extending from the headrail and being sized and positioned to block light from passing from one side of the blind through the gap to an opposite side of the blind.

13. The window blind of claim 1 also comprising a tilt mechanism comprising:

a. a shaft positioned within the headrail and having a double helix threaded portion and portions to which the tilt cords can be attached;

b. a nut on the threaded portion of the shaft;

c. a first magnet attached to the nut and positioned for placement adjacent the inner surface of a pane of glass; and d. a slide having a second magnet positioned opposite the first magnet such that movement of the slide and second magnet in one direction moves the nut in that same direction causing the shaft to rotate in a clockwise direction and movement of the slide and second magnet in an opposite direction moves the nut in that opposite direction causing the shaft to rotate in a counterclockwise direction, wherein the slide is comprised of a generally rectangular housing having a slot and a tab projecting through the slot and attached to the second magnet, the tab projecting outwards from the housing such that the tab can be grasped manually and moved within the slot to move the second magnet with respect to the housing thereby causing the shaft to rotate an amount corresponding to a distance over which the tab is moved.

14. The window blind of claim 13 wherein at least one of the first magnet and the second magnet is a neodymium magnet.

15. The window blind of claim 13 wherein at least one of the threaded portion and the nut is a thermoplastic.

16. The window blind of claim 13 wherein the slide is comprised of a generally rectangular housing and a tab slidably attached to the housing, the second magnet being attached to the tab.

17. An improved double pane window of the type having a frame carrying a first pane of glass which has an inside surface and an outside surface, a second pane of glass and a window blind positioned between the panes of glass, the window blind of the type having a headrail, a bottom rail, a plurality of lift cords extending from the headrail to the bottom rail, a plurality of slats between the bottom rail and the headrail, and a plurality of ladders on which the slats rest, each ladder having a pair of spaced apart rails, each lift cord being substantially coplanar with the rails of a ladder wherein the bottom rail comprises:

a. an elongated body having an outwardly curving top attached along a front edge and along a back edge to an outwardly curving bottom, the top having at least one opening through which the lift cords pass and the bottom having a hole for each ladder, wherein the rails of a ladder and all lift cords coplanar with that ladder, pass through the hole for that ladder; and b. a rivet passing through each hole retaining the rails and lift cords passing through that hole by frictionally engaging the rails and lift cords with said hole.

18. The improved window of claim 17 wherein the slats are curved and have a same curvature as the top of the bottom rail.

19. The improved window of claim 17 also comprising pivot pins attached to opposite ends of the bottom rail.

20. The improved window of claim 19 wherein the bottom rail is sized and configured to permit rotation of the bottom rail about the pivot pins of as much as 150° to 180°.

21. The window blind of claim 17 wherein one rail of each ladder extends over the front edge and one rail of each ladder extends over the back edge.

22. The improved window of claim 17 wherein at least one of the first pane of glass and the second pane of glass is removable from the frame.

* * * * *